US006994457B2

(12) United States Patent
Lee

(10) Patent No.: US 6,994,457 B2
(45) Date of Patent: Feb. 7, 2006

(54) RECESSED DOWNLIGHT LIGHTING APPARATUS

(75) Inventor: Ward Lee, Gaffney, SC (US)

(73) Assignee: JJI Lighting Group, Inc., Greenwich, CT (US)

( * ) Notice: Subject to any disclaimer, the term of this patent is extended or adjusted under 35 U.S.C. 154(b) by 183 days.

(21) Appl. No.: 10/639,446

(22) Filed: Aug. 13, 2003

(65) Prior Publication Data

US 2005/0036321 A1 Feb. 17, 2005

(51) Int. Cl.
*F21V 17/00* (2006.01)

(52) U.S. Cl. ..... 362/366; 362/365; 362/153.1; 248/343

(58) Field of Classification Search ..... 362/153.1, 362/365, 366; 248/343
See application file for complete search history.

(56) References Cited

U.S. PATENT DOCUMENTS

| | | | | |
|---|---|---|---|---|
| 4,733,339 A | | 3/1988 | Kelsall | 362/366 |
| 5,122,944 A | | 6/1992 | Webb | 362/365 |
| 5,567,041 A | | 10/1996 | Slocum | 362/148 |
| 5,609,414 A | | 3/1997 | Caluori | 362/366 |
| 5,738,436 A | | 4/1998 | Cummings et al. | 362/294 |
| 5,826,970 A | | 10/1998 | Keller et al. | 362/147 |
| 5,941,625 A | | 8/1999 | Morand | 362/148 |
| 6,113,245 A | * | 9/2000 | Reinert, Sr. | 362/153.1 |
| 6,132,069 A | | 10/2000 | Sato et al. | 362/365 |
| 6,375,338 B1 | | 4/2002 | Cummings et al. | 362/276 |
| 6,431,723 B1 | | 8/2002 | Schubert et al. | 362/147 |
| 6,505,960 B2 | | 1/2003 | Schubert et al. | 362/365 |

* cited by examiner

*Primary Examiner*—Stephen F Husar
(74) *Attorney, Agent, or Firm*—Fitzpatrick, Cella, Harper & Scinto

(57) ABSTRACT

A light fixture including an outer ring, middle ring, and inner ring, each of which having generally a cylindrical shape. The outer ring has a flange at one end and a threaded female portion on an interior surface. The middle ring has a flange at one end and a threaded male portion on an exterior surface. When the outer ring is mated to the middle ring, the male portion is threaded into the female portion. The inner ring has a plurality of grooves on an exterior surface. The threaded male portion of the middle ring includes a plurality of openings for receiving a plurality of securing members, with each of the plurality of securing members capable of moving in each of the plurality of grooves and capable of securing the middle ring to the inner ring.

20 Claims, 4 Drawing Sheets

RECESSED DOWNLIGHT LIGHTING APPARATUS

BACKGROUND OF THE INVENTION

1. Field of the Invention

The present invention relates generally to the field of light fixtures and more specifically, to a recessed light fixture.

2. Background of the Invention

Various recessed downlight light fixtures have been designed for use in ceilings. Usually such fixtures create problems when it is necessary to relamp or reballast the fixture because of the difficulty encountered in removing the light fixture from the ceiling or gaining access to the light fixture's internal components.

Recessed ceiling light fixtures known in the art use different means of securing their components to each other and to a ceiling structure. For example, U.S. Pat. No. 5,567,041 discloses a recessed ceiling light having an outer housing, which includes an integral flange, and an inner housing, which is secured in position in the outer housing by spokes. The outer housing includes a cylindrical support ring to which the outer lens is secured to the outer housing by a threaded arrangement. Thus, the components of this light fixture are held in place by a complex combination of spokes and threaded fittings.

U.S. Pat. No. 5,826,970 discloses a recessed ceiling light fixture that includes an outer housing, which is supported in the sheet rock of the ceiling by support arms, a conical cup, which includes a peripheral flange, and an inner member, which is inserted into the conical cup. The inner member is supported within the outer housing by springs, while the conical cup is supported on the outer housing by a friction fit. Thus, the components of this light fixture are held in place in the ceiling by a combination of support arms, spring members, and a friction fit.

U.S. Pat. No. 5,738,436 discloses a modular lighting fixture that uses a spring member to secure the reflector module to the housing. U.S. Pat. No. 5,941,625 discloses a recessed light fixture that uses a spring clip to secure the light fixture to its housing and to a ceiling structure. U.S. Pat. No. 5,609,414 discloses a recessed lighting fixture that uses a pair of retaining clips and other components to secure the light fixture to its housing and to a ceiling structure.

In addition to the above, there are known light fixtures that are difficult to assemble and disassemble due to the intricate connecting means of their components. In such instances, the sheet rock and layer of spackle abutting the light fixture are damaged when a user has to pull on the light fixture or inordinately twist the light fixture to assemble or disassemble it. In addition, other known light fixtures are preset for use in ceilings or similar structures containing ½-inch, ¾-inch or 1-inch sheet rock.

Thus, the prior art does not teach or suggest a recessed light fixture that includes a structure that makes assembly and disassembly of the light fixture simple.

SUMMARY OF THE INVENTION

It is an object of the present invention to provide a recessed light fixture that includes features that make assembly and disassembly of the light fixture simple.

It is another object of the present invention to provide a recessed light fixture that includes features that make relamping and reballasting of the fixture simple.

It is another object of the present invention to provide a light fixture that can be used with sheet rock of different sizes.

According to one aspect of the present invention, the light fixture includes an outer member, a middle member, and an inner member, each of which has a generally cylindrical shape in the form of a ring. The outer member has a peripherial circular flange at one end and a threaded interior surface. The middle member has a similar flange at one end and a threaded male portion on its exterior surface. The outer member is connected to the middle member by threadedly engaging their respective thread surfaces.

The inner member has an exterior surface on which a plurality of grooves are formed therein, with the grooves extending transversely on its cylindrical wall. The middle member includes a plurality of openings for receiving a plurality of securing members, e.g. set screws, with each of the plurality of securing members having inner ends and being located such that these ends will be respectively received in the grooves, for securing the middle member to the inner member.

The above and other objects, features and advantages of this invention will be apparent to those skilled in the art from the following detailed description of illustrative embodiments of the invention, which is to be read in connection with the accompanying drawings, wherein:

DETAILED DESCRIPTION OF THE PREFERRED EMBODIMENTS

As mentioned above, the present invention is directed to a recessed light fixture, and in particular, to a light fixture including an outer ring, a middle ring, and an inner ring. The light fixture can be used in a variety of applications, but is preferably secured in a housing mounted in a ceiling, in a down-light application.

Figure 1:
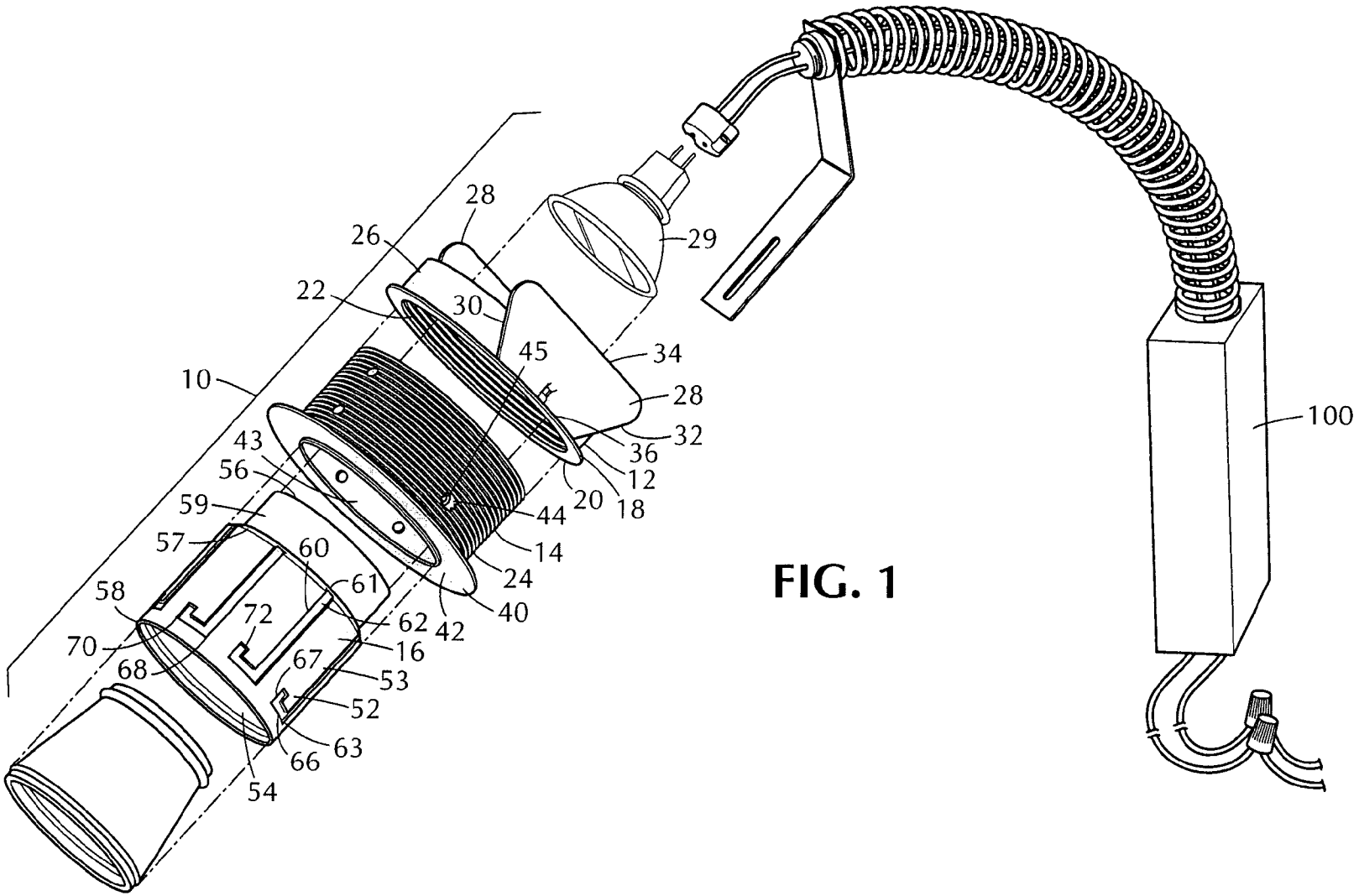
FIG. 1 is an exploded perspective view of a light fixture constructed in accordance with the present invention.

Referring now to the drawings in detail, and initially to FIG. 1, the light fixture 10 includes an outer ring 12, a middle ring 14, and an inner ring 16.

Outer ring 12 is cylindrically shaped and has a circular peripheral flange 18 formed at one end 20 thereof. Cylindrical ring 12 has a threaded inner surface 22 which is adapted to receive a corresponding externally-threaded outer surface 24 of middle ring 14. The outer cylindrical surface portion 26 of ring 12 is generally smooth. Flat springs 28 having front and rear edges 30, 32, and top and bottom edges 34, 36, are secured to the outside surface of ring 12 by screws 45, rivets, welding or other securing means known by those skilled in the art. Such securing means should be selected so as not to impede the threading of middle ring 14 into outer ring 12.

Figure 3:
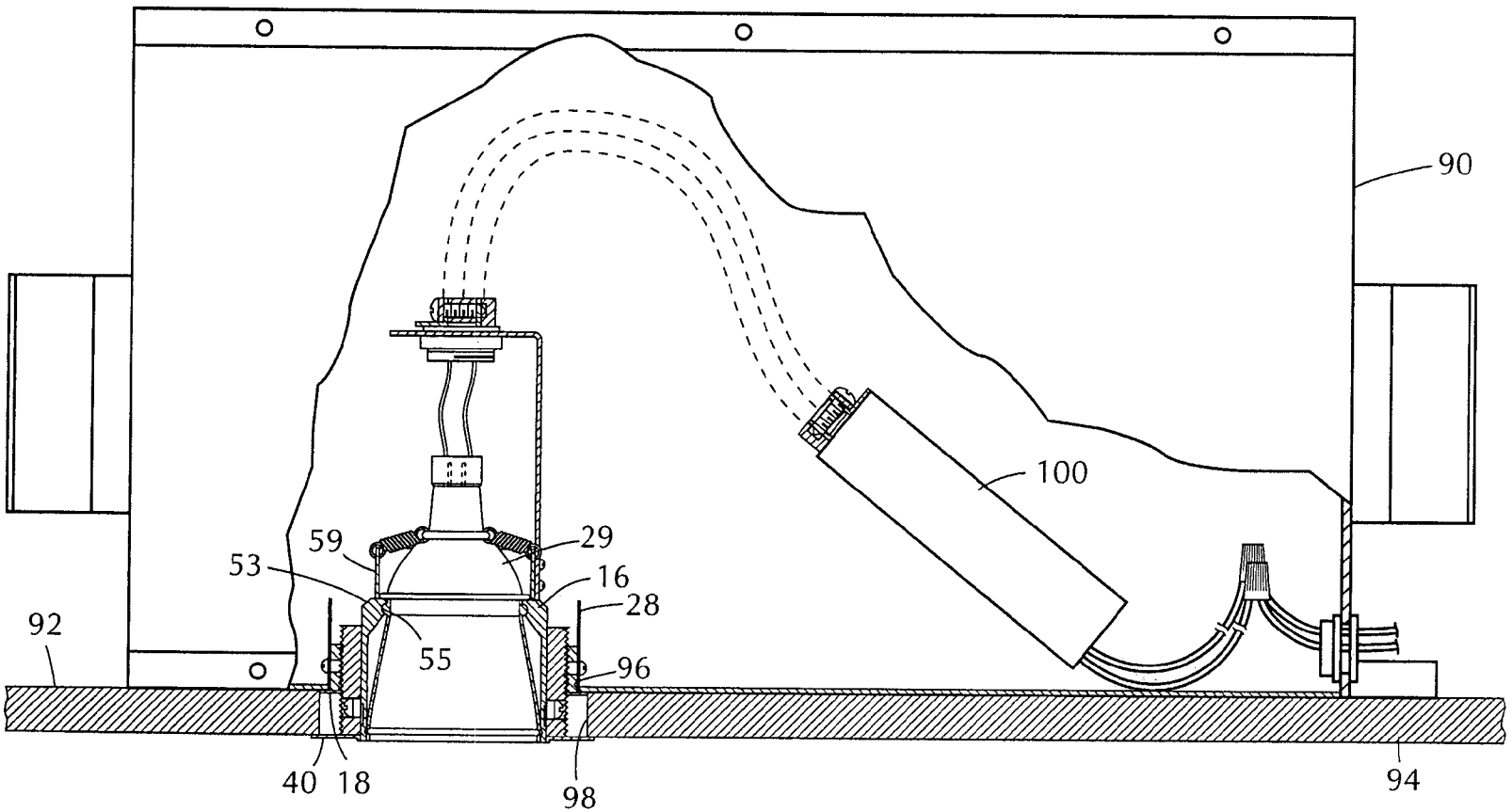
FIG. 3 is a side view showing the light fixture installed in a rectangular support assembly in a ceiling.
Figure 5:
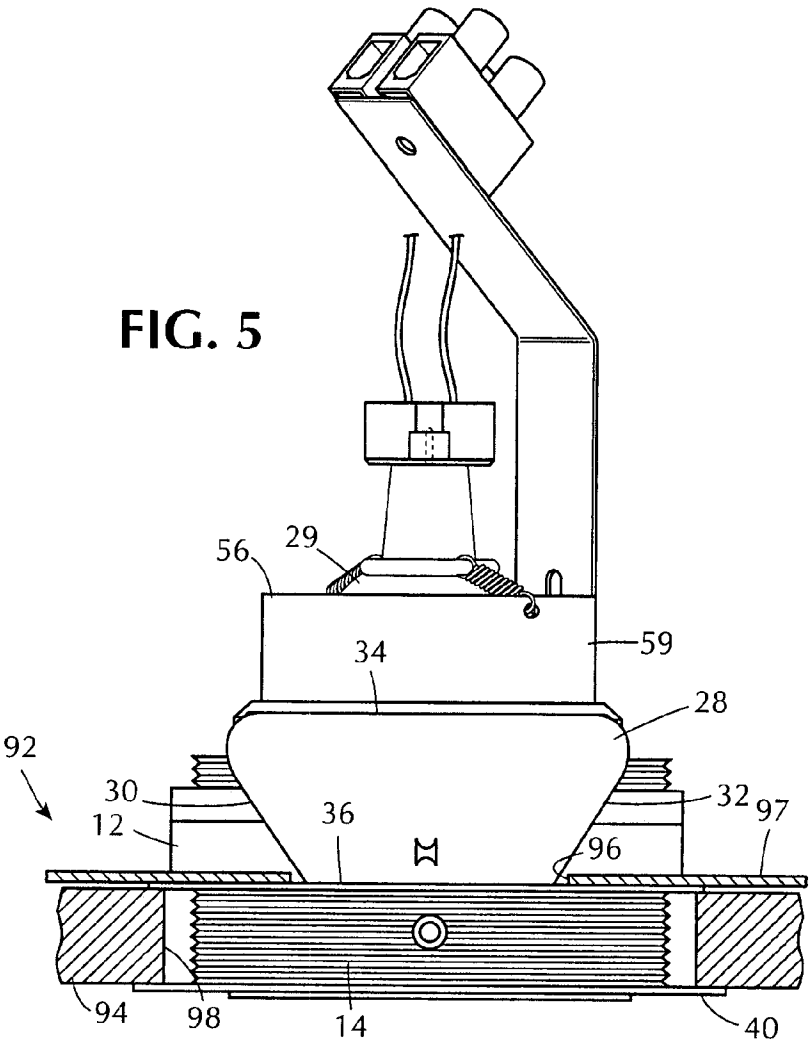
FIGS. 4 and 5 are elevational views of the light fixture taken approximately 90° from each other.
Figure 4:
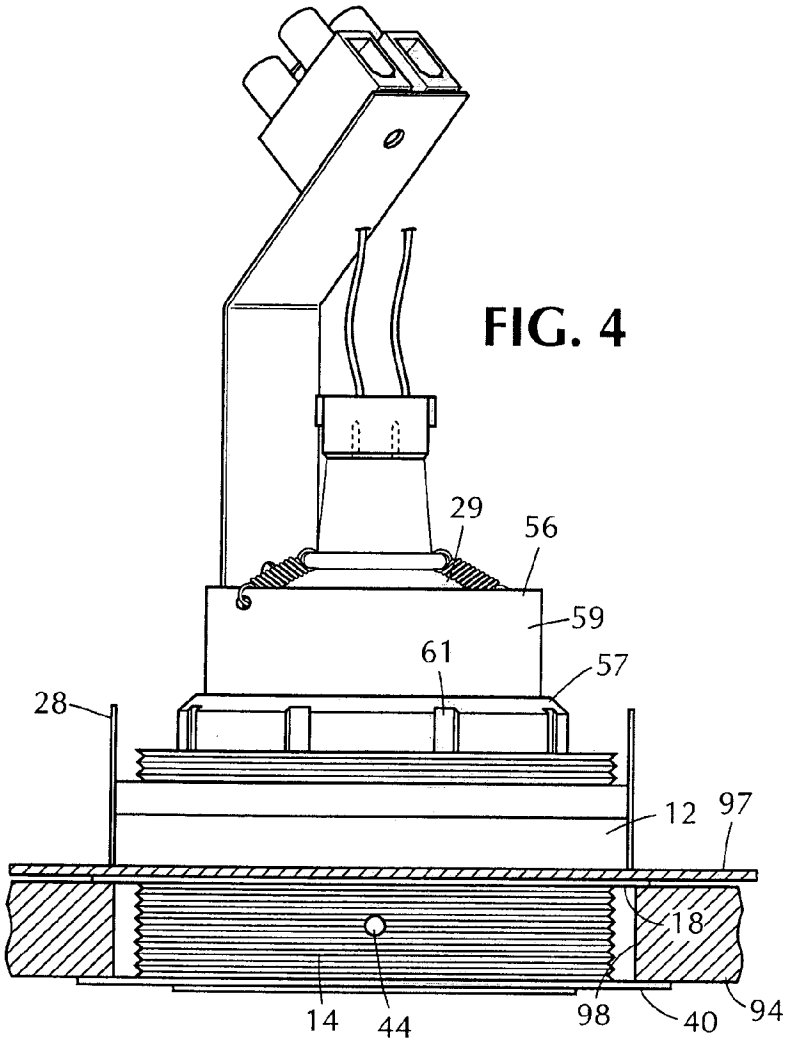

Each spring 28 is preferably flat and has a general wing-shape. As seen in FIG. 1, front and rear edges 30, 32 of springs 28 taper towards the flange 18. These springs are preferably used in pairs, with each pair preferably being located on diametrically opposed sides of outer ring 12. As seen in FIGS. 3–5, springs 28 serve to retain ring 12 and thus the entire lamp 10 in a protective sheet metal box 90 mounted in the ceiling 92 above the ceiling sheet rock 94 by supporting ring 12 on the edge of a circular hole 96 formed in the based 97 of box 90. The box 90 is positioned in the ceiling so hole 96 aligns with a slightly larger hole 98 in sheet rock 94. It protects the fixture 10, ballast 100 and associated wiring from dust, heat and the like. The internal diameter of outer ring 12 is preferably 3-inches, but in any case is large enough to allow the fixture's light bulb 29, electrical connections, wiring and ballast 100 to pass through the internal diameter of outer ring 12 for relamping and reballasting.

Middle ring 14 is also cylindrical in shape and has a circular peripheral flange 40 formed at its lower end 42. As noted above, the outside surface of ring 14 is threaded to engage the threads on the inside surface of outer ring 12. This threading feature allows the light fixture to be used with sheet rock of different sizes, preferably in the range of ½" to 1¼". Thus, as seen in FIGS. 3–5, when ring 14 is threaded into ring 12 the thickness of the sheet rock is captured between the flange 40 of the ring 14 and the base 97 of box 90 to conceal the hole 98 and flange 18 of ring 12.

Ring 14 has an inner surface 43 which is preferably smooth. Transverse, radial openings 44 are formed in the cylindrical portion of ring 14. These openings 44 preferably comprise at least two circular ¼-inch threaded openings for respectively receiving set screws 45, whose inner ends serve to secure the inner ring 16 in the fixture as described hereinafter. The inside diameter of middle ring 14, like the inside diameter of outer ring 12 described above, also must be large enough to allow the fixture's light bulb 29, electrical connections and wiring, and ballast 100 to pass through its internal diameter for relamping and reballasting.

Inner ring 16 is also generally cylindrical and has an outer surface 52, an inner surface 54, and top and bottom edges 56, 58. Inner ring 16 preferably does not have any flanges. The internal diameter of inner ring 16 is preferably not less than 2¾". Inner surface 54 includes an internal circular ridge 55 (seen in FIG. 3) that the outer rim of the light bulb 29 rests on. Outer surface 52 has a first surface portion 53 and a second surface portion 59 of smaller outside diameter connected by a chamfered edge 57. Surface 53 has a plurality of L-shaped grooves 60 formed therein. The upper end 61 of leg 62 of the grooves start at the chamfered edge 57 and extend on outer surface 53 of inner ring 16 toward its lower end 63 to the horizontal leg 66 of the L. Each groove has a second vertical leg 67, shorter than the first leg 62, joined to the other end of the horizontal leg 66 thereby to define a first elbow and second elbows in the grooves. The upper end of the second vertical leg 67 in each groove defines a stop or a secured position 72 for ring 16 in ring 14. More specifically, when ring 16 is inserted into ring 14, as seen in FIG. 1, the upper ends of two legs 62 at chamfer 57 are aligned with the inner ends of the set screws 45 mounted in ring 14 so that upon insertion of the ring 16 those ends travel in the leg 62 of the groove to elbow 68. At that position further insertion is prevented. The installer will then rotate ring 16 to allow the ends of the set screw 45 to travel in leg 66 to elbow 70, where further rotation is prevented. By pulling the ring 16 downwardly at that point the set screw 45 will enter leg 67 and engage the stop surface 72. At that position the inner ring 16 is supported on the set screws 45 and cannot fall out of the fixture. The width and depth of each groove 60 is preferably ¼-inch and 1/16-inch, respectively. However, a person of ordinary skill in the art will readily understand that the length, width, and size of these grooves and the other components of this light fixture may vary to fit a particular application.

Figure 2:
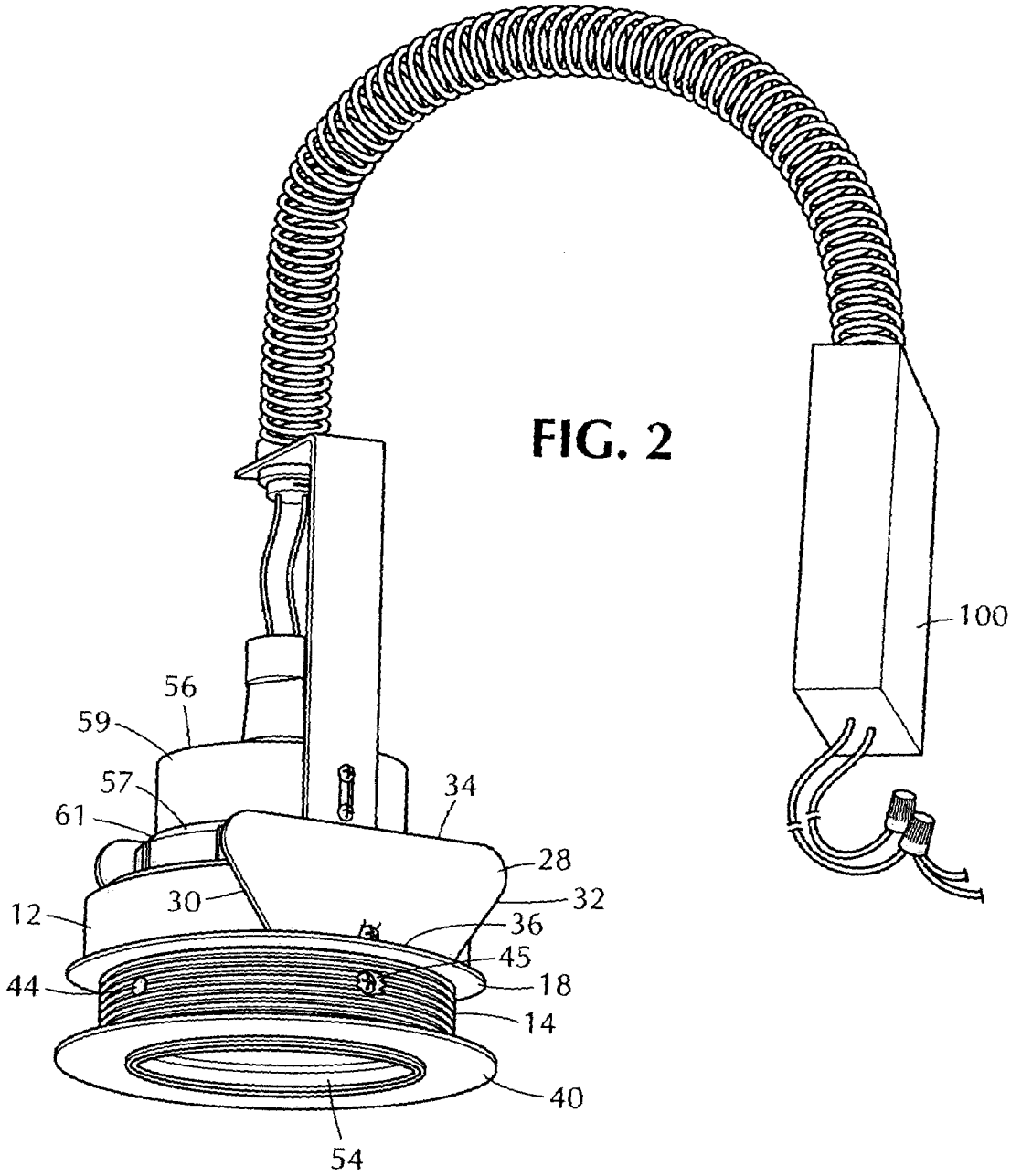
FIG. 2 is a perspective view of an assembled light fixture constructed in accordance with the present invention.

Installation of light fixture 10 in the rectangular support structure or a sheet metal box 90 (as seen in FIG. 3), is performed by first slipping one of the springs 28 of outer ring 12 through the hole in the sheet metal box 90, and then squeezing the other flat spring 28 to curve against the cylindrical position of the outer ring 12 to allow it to slip through the hole in the sheet metal box 90. In that position the outer ring 12 can be pushed into the sheet metal box's housing 90 until flange 18 blocks further movement. The springs 28 open to their flat position once past hole 96 and lock outer ring 12 in place in housing 90. Next, as seen for example in FIGS. 3–5, middle ring 14 is threaded into outer ring 12 to a desired depth based on the thickness of the sheet rock. Then, to install inner ring 16, grooves 60 are aligned with the ends of the set screws 45. Inner ring 16 is pushed in until the set screws 45 move forward into first elbow 68 of the leg 62. Then, middle ring 14 is held for example in one's left hand and inner ring 16 is rotated clockwise by one's right hand until the set screws 45 reach second elbow 70 of leg 64. By gently pushing inner ring 16 downwardly, the set screws 45 move to the stop or secured position 72, thereby locking inner ring 16 in middle ring 14. An assembled light fixture 10 is seen in FIGS. 2, 4 and 5.

Disassembly of light fixture 1 to relamp or reballast is done by performing the steps described above in reverse order. To remove inner ring 16 from its engagement with middle ring 14, this apparatus uses a "lift and shift" movement. This is done by manually pushing ring 16 inwardly, thereby "lifting" it until the ends of the set screws 45 reach elbow 70 of leg 67. The inner ring 16 is then rotated, i.e., "shifted" counterclockwise until it stops in first elbow 68 of the leg 62. Inner ring 16 is then gently pulled downwardly, thereby releasing it from middle ring 14. When inner ring 16 is released and pulled down further, the light bulb 29 is exposed, thereby allowing it to be changed. In addition, the wiring and ballast 100 can be pulled further downward through the opening in middle ring 14 thereby allowing the ballast 100 to be changed or repairs to be made to the fixture's internal components without removing the entire fixture from the ceiling.

Although an illustrative embodiment of the present invention has been described herein with reference to the accompanying drawings, it is to be understood that various changes and modifications may be effected therein by those skilled in the art without departing from the scope or spirit of this invention.

What is claimed is:

1. A recessed light fixture comprising:

a cylindrical outer ring having a central opening, inner and outer ends and a threaded interior surface;

means on said outer ring for mounting the outer ring in a surface in which the light fixture is to be recessed adjacent a bulb located within said surface;

a cylindrical middle ring having a central opening, a flange at one end and a threaded exterior adapted to be received and threadably engaged in said outer ring;

a cylindrical inner ring having a central opening and an exterior surface, parallel to said threaded surfaces of the outer and middle ring, having a plurality of grooves formed therein, said grooves including stop surfaces; and cooperating means on said middle ring for removably supporting said inner ring in said middle ring by engagement with said stop surfaces.

2. The light fixture according to claim 1, wherein the cooperating means comprise set screws mounted in said middle ring and engaged in said grooves.

3. The light fixture according to claim 1, wherein said means for mounting the outer ring comprises a plurality of spring members secured to an exterior surface of said outer ring.

4. The light fixture according to claim 1, wherein the opening in said middle ring has an internal diameter of sufficient size to allow the light fixture's components to pass through.

5. The light fixture according to claim 4, wherein the components comprise a light bulb, electrical wiring, and ballast.

6. The light fixture according to claim 1, wherein each of the plurality of grooves comprise a first vertical leg, a second vertical leg, and a horizontal leg connecting the first vertical leg to the second vertical leg.

7. The light fixture according to claim 6, wherein the stop surfaces comprise meeting points of the first vertical leg with the horizontal leg, of the second vertical leg with the horizontal leg, and an upper position of the second vertical leg.

8. The light fixture according to claim 1, wherein the cooperating means comprise set screws mounted in said middle ring and engaged in said grooves.

9. A light fixture comprising:

a cylindrical outer ring having a peripheral flange at one end and a threaded interior surface;

a cylindrical middle ring having a flange at one end and a threaded exterior surface adapted to be received and threadably engaged in said outer ring; and a cylindrical inner ring including an exterior surface having a plurality of grooves formed therein, said grooves including stop surfaces and cooperating means on said middle ring for removably supporting said inner ring in said middle ring by engagement with said stop surfaces; and further comprising a plurality of spring members secured to an exterior surface of said outer ring.

10. The light fixture according to claim 9, wherein said plurality of spring members secure the light fixture in a ceiling support structure.

11. The light fixture according to claim 9, wherein said middle ring has an internal diameter of sufficient size to allow the light fixture's components to pass through.

12. A light fixture comprising:

a cylindrical outer ring having a peripheral flange at one end and a threaded interior surface;

a cylindrical middle ring having a flange at one end and a threaded exterior surface adapted to be received and threadably engaged in said outer ring; and a cylindrical inner ring including an exterior surface having a plurality of grooves formed therein, said grooves including stop surfaces and cooperating means on said middle ring for removably supporting said inner ring in said middle ring by engagement with said stop surfaces; and wherein said middle ring has an internal diameter of sufficient size to allow the light fixture's components to pass through and the components comprise a light bulb, electrical wiring, and a ballast.

13. A light fixture comprising:

a cylindrical outer ring having a peripheral flange at one end and a threaded interior surface;

a cylindrical middle ring having a flange at one end and a threaded exterior surface adapted to be received and threadably engaged in said outer ring; and a cylindrical inner ring including an exterior surface having a plurality of grooves formed therein, said grooves including stop surfaces and cooperating means on said middle ring for removably supporting said inner ring in said middle ring by engagement with said stop surfaces; and wherein each of the plurality of grooves comprise a first vertical leg, a second vertical leg, and a horizontal leg connecting the first vertical leg to the second vertical leg.

14. The light fixture according to claim 13, wherein the stop surfaces comprise meeting points of the first vertical leg with the horizontal leg, of the second vertical leg with the horizontal leg, and an upper position of the second vertical leg.

15. A light fixture comprising:

a cylindrical outer ring having a peripheral flange at one end and a threaded interior surface, wherein a plurality of spring members are secured to an exterior surface of said outer ring;

a cylindrical middle ring having a flange at one end and a threaded exterior surface adapted to be received and threadably engaged in said outer ring; and a cylindrical inner ring including an exterior surface having a plurality of grooves formed therein, said grooves including stop surfaces and cooperating means on said middle ring for removably supporting said inner ring in said middle ring by engagement with said stop surfaces.

16. A light fixture comprising:

a cylindrical outer ring having a peripheral flange at one end and a threaded interior surface, wherein a plurality of spring members are secured to an exterior surface of said outer ring;

a cylindrical middle ring having a flange at one end and a threaded exterior surface adapted to be received and threadably engaged in said outer ring; and a cylindrical inner ring including an exterior surface having a plurality of grooves formed therein, said grooves including stop surfaces and cooperating means on said middle ring for removably supporting said inner ring in said middle ring by engagement with said stop surfaces, wherein the cooperating means comprise set screws mounted in said middle ring and engaged in said grooves.

17. A light fixture comprising:

a cylindrical outer ring having a central opening and a threaded interior surface;

a cylindrical middle ring having a central opening, a flange at one end and a threaded exterior surface adapted to be received and threadably engaged in said outer ring; and a cylindrical inner ring having a central opening and an exterior surface having a plurality of grooves formed therein, said grooves including stop surfaces; and cooperating means on said middle ring for removably supporting said inner ring in said middle ring by engagement with said stop surfaces;

said middle ma having an internal diameter of sufficient size to allow the light fixture's components to pass through and said components comprising a light bulb, electrical wiring, and ballast.

18. A light fixture comprising:

a cylindrical outer ring having a central opening and a threaded interior surface;

a cylindrical middle ring having a central opening, a flange at one end and a threaded exterior surface adapted to be received and threadably engaged in said outer ring; and a cylindrical inner ring having a central opening and an exterior surface having a plurality of grooves formed therein, said grooves including stop surfaces; and cooperating means on said middle ring for removably supporting said inner ring in said middle ring by engagement with said stop surfaces;

each of the plurality of grooves comprising a first vertical leg, a second vertical leg, and a horizontal leg connecting the first vertical leg to the second vertical leg.

19. The light fixture according to claim 18, wherein the stop surfaces comprise meeting points of the first vertical leg with the horizontal leg, of the second vertical leg with the horizontal leg, and an upper position of the second vertical leg.

20. The light fixture according to claim 19, wherein the cooperating means comprise set screws mounted in said middle ring and engaged in said grooves.

* * * * *